US005881480A

United States Patent [19]

Fall

[11] Patent Number: 5,881,480

[45] Date of Patent: Mar. 16, 1999

[54] CARBIDE EMBEDDED GRADER BLADE

[75] Inventor: James H. Fall, Oberlin, Kans.

[73] Assignee: Jim Fall Enterprises, Inc., Oberlin, Kans.

[21] Appl. No.: 604,443

[22] Filed: Feb. 21, 1996

[51] Int. Cl.[6] ..... E02F 3/80

[52] U.S. Cl. ..... 37/460; 172/701.3; 172/719

[58] Field of Search ..... 37/460, 446, 451, 37/453, 458, 459; 172/701.1, 701.3, 719

[56] References Cited

U.S. PATENT DOCUMENTS

| | | | |
|---|---|---|---|
| 1,922,917 | 8/1933 | Russell et al. . | |
| 3,529,677 | 9/1970 | Stephenson | 172/767 |
| 3,719,790 | 3/1973 | Plockinger et al. | 37/460 X |
| 3,888,027 | 6/1975 | Toews . | |
| 3,934,654 | 1/1976 | Stepehnson et al. | 37/460 X |
| 4,011,051 | 3/1977 | Helton et al. | 29/182 |
| 4,052,802 | 10/1977 | Moen et al. | 37/446 X |
| 4,086,966 | 5/1978 | Lanz et al. | 172/767 |
| 4,715,450 | 12/1987 | Hallissy et al. | 172/701.3 |
| 4,770,253 | 9/1988 | Hallissy et al. | 172/701.3 |
| 4,903,609 | 2/1990 | Isakov et al. | 37/460 |
| 5,224,555 | 7/1993 | Bain et al. | 172/772.5 |
| 5,427,186 | 6/1995 | Adrian et al. | 37/460 X |

FOREIGN PATENT DOCUMENTS

| | | | |
|---|---|---|---|
| 208330 | 10/1966 | Sweden | 172/701.3 |

*Primary Examiner*—Thomas B. Will
*Assistant Examiner*—Robert Pezzuto
*Attorney, Agent, or Firm*—Jacobson, Price, Holman & Stern, PLLC

[57] ABSTRACT

A high wear-resistant grader blade which combines two high wear-resistant elements in the lower end of the blade. First, high wear-resistant particles are embedded into the front leading edge of the blade. More particularly, the leading edge of the blade is heated to pool molten metal. Tungsten carbide particles are then added to the pooled molten metal so as to blend with the molten metal. Upon cooling, the tungsten carbide particles mixed with the melted grader blade metal, will penetrate into the surface of the grader blade and will form a protrusion outward from the surface of the grader blade. Thus, the leading edge of the grader blade will be formed of a mixture of tungsten carbide and the grader blade material. Second, a groove is milled down the center of the grader blade and high wear-resistant inserts laid end-to-end are brazed into the groove.

18 Claims, 2 Drawing Sheets

CARBIDE EMBEDDED GRADER BLADE

BACKGROUND OF THE INVENTION

1. Field of the Invention

The present invention relates to a grader blade used on a motor or tractor driven grader for grading road beds, ground surfaces and the like. More particularly, the present invention relates to grader blades having carbide inserts or other wear resistant welded surfaces along the ground engaging edge for better wear resistance.

2. Description of the Related Art

Ground engaging tools have been developed to maintain or create a desired ground surface, particularly for roadways. Conventional ground engaging machines generally employ a moldboard that has a scoop-like or concave shape, such as utilized on a grader, scraper or snow plow. The moldboard is pushed or pulled across the ground in order to scrape, grade, or otherwise level the ground surface. In order to reduce wear and tear on the moldboard, an extension piece, called a grader blade, is commonly mounted on the moldboard and used for the ground shaping.

Grader blades are commonly made of materials having a much higher degree of wear-resistance than the moldboard, which is typically made of steel. The grader blades are then secured longitudinally along to the lower portion of the moldboard by screws or bolts. Once the grader blade becomes worn, it can be easily removed and replaced with a new grader blade.

Grader blades have been developed having inserts along the front leading edge of the blade. The inserts are typically made of a highly wear-resistant material in order to reduce wear on the entire blade. One such grader blade is shown in U.S. Pat. No. 4,770,253, issued to Hallisy, et al. entitled "Grader Blade with Tiered Inserts on Leading Edge."

As shown in the aforesaid Hallisy patent, the inserts provided for grader blades typically run the entire front length of the blade. However, U.S. Pat. No. 1,922,917, issued to Russell, et al. entitled "Grader Blade", shows a grader blade having a plurality of teeth located at spaced intervals along the lower edge of the grader blade. The teeth protrude from the grader blade in order to cut knolls, mounds or ridges in the ground surface. In addition, U.S. Pat. No. 4,011,051, issued to Helton, et al., entitled "Composite Wear-Resistant Alloy, and Tools from Same" shows a wear-resistant insert secured to the back face of the grader blade.

Another grader blade having an insert is shown in U.S. Pat. No. 4,086,966 to Lanz, et al., entitled "Composite Ground Engaging Tool." Lanz, et al. provide a grader blade with a high wear-resistant insert located centrally within the lower portion of the blade so that the insert is sandwiched between the front and rear surfaces of the blade.

Conventional grader blades secure the insert to the grader blade by brazing or welding. These techniques have sometimes been found undesirable because the inserts may become loose and fall off during high-impact grading, thus resulting in premature blade failure.

SUMMARY OF THE INVENTION

Accordingly, it is an object of the present invention to provide a grader blade that is highly wear-resistant. It is a further object of the invention to provide a grader blade having an a front leading edge and insert that will not become loose and/or fall off during high-impact grading. It is yet another object of the invention to provide a grader blade that is simplistic in design and which parts can be easily and economically manufactured.

The grade blade of the present invention overcomes the deficiencies of conventional grader blades by combining two high wear-resistant elements in the lower end of the blade. First, high wear-resistant particles are uniquely embedded into the leading edge of the conventional grader blade, typically made of high strength steel. More particularly, particles of a high wear-resistant material are molded into the leading edge of the grader blade, substantially along the entire length of the leading edge. This unique molding is accomplished by heating the lower edge of the blade to a molten state. Tungsten carbide, or other high wear-resistant, particles are then applied to the molten leading edge so as to blend with and become embedded in the leading edge portion of the blade. Upon cooling, the tungsten carbide or other particles become molded with and impregnated in the blade portion and form a protrusion outwardly from the leading edge surface of the blade. As such, the leading edge of the grader blade becomes formed of a mixture of tungsten carbide and the steel blade material.

Second, a high wear-resistant insert, such as tungsten carbide alloy inserts, is located centrally in the bottom edge of the blade. The insert extends longitudinally also substantially along the entire length of the blade. The insert is installed preferably after the molding process described above by milling a groove down the center of the lower edge of the blade, and then brazing, preferably short inserts end-to-end, into the groove so that their lower surface is flush with the unmilled portion of the lower edge of the grader blade.

By combining the carbide embedding and the carbide insert as aforedescribed, it is believed that a synergism is achieved for effecting an extremely high wear-resistance for the ground engaging edge portion of the blade. More specifically, the inserts are placed in the bottom edge of the blade for extended wear life of the blade. It is believed that embedding the leading edge with the carbide or other high wear-resistant particles serves a dual purpose. The embedding adds a substantial amount of abrasion resistant material to further extend blade life, and it creates a protective shield along the face of the cutting edge to prevent metal in the blade from "washing out" or eroding away, thus causing the inserts to become exposed and fall out.

These and other objects of the invention, as well as many of the intended advantages thereof, will become more readily apparent when reference is made to the following description taken in conjunction with the accompanying drawings in which numbers correspond.

DETAILED DESCRIPTION OF THE PREFERRED EMBODIMENTS

Figure 1:
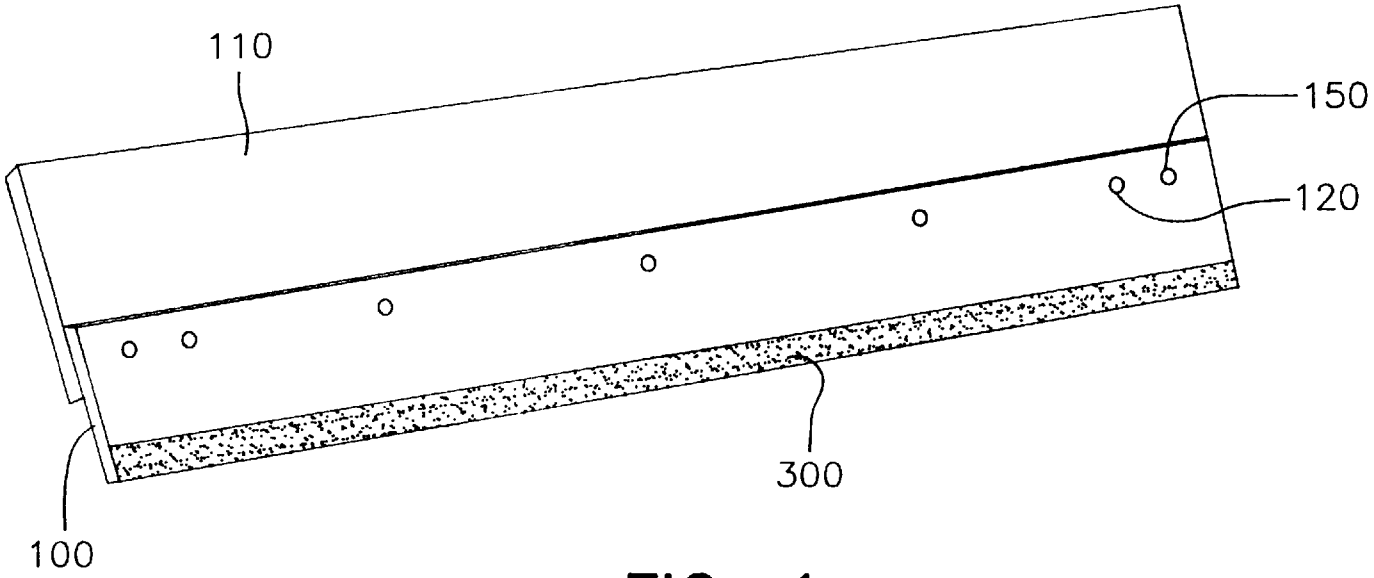
FIG. 1 is a perspective view of a grader blade of the present invention; and, FIG. 2 shows a cross-sectional side view of the grader blade of the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

FIG. 1 shows grader blade 100 secured to a moldboard 110 by a threaded bolt 120 or the like. Generally, grader blade 100 includes cylindrical through-hole bores 150, longitudinally extending insert 200 and longitudinal embedding 300. Bores 150 receive a screw or bolt 120 that are used to secure the grader blade 100 to the moldboard. Bores 150 are located in the upper portion of grader blade 100. Preferably, a plurality of bores 150 are located along the length of the grader blade 100 to firmly affix the grader blade 100 to the moldboard.

Figure 2:
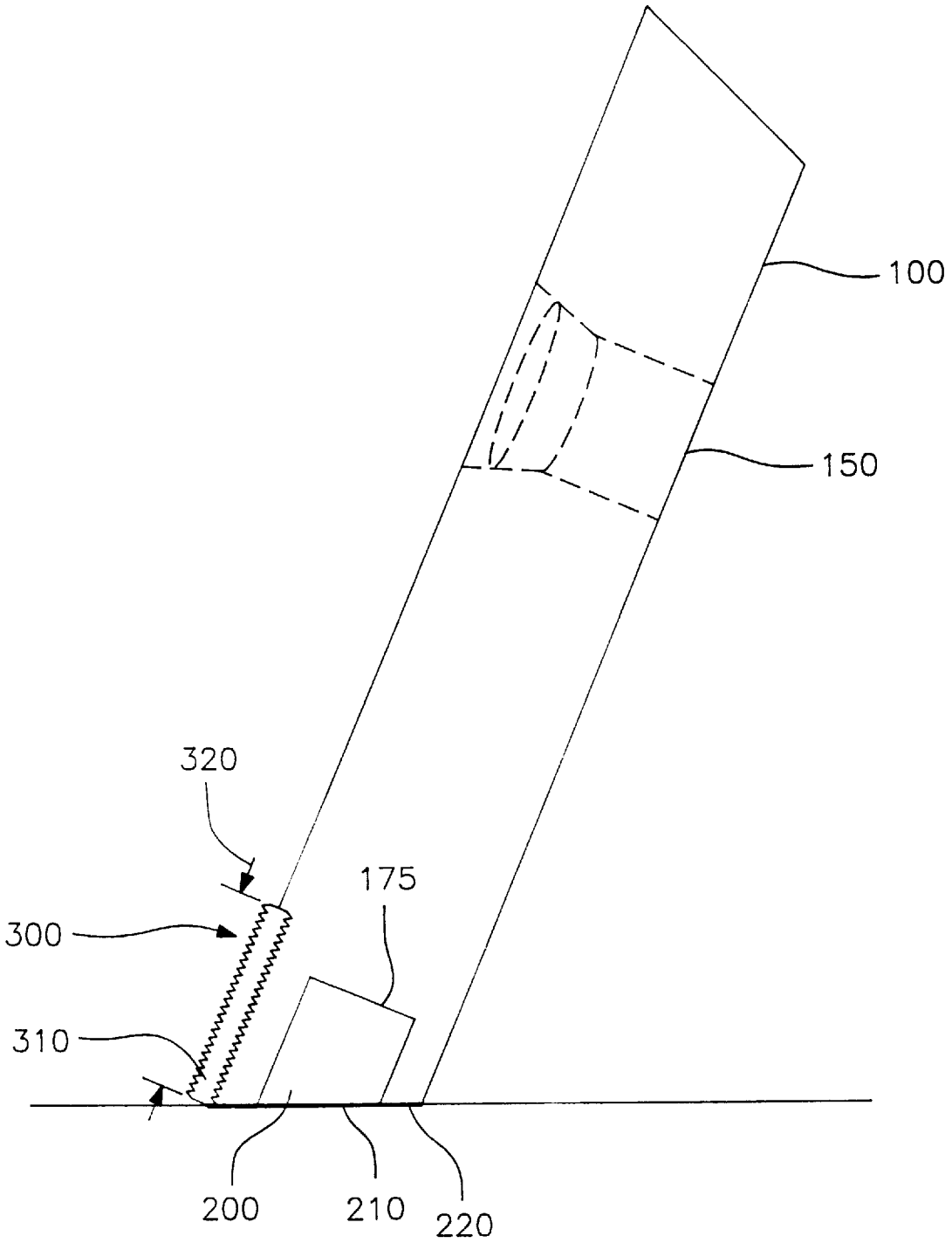

FIG. 2 shows a cross-sectional side view of the grader blade 100 of the present invention. The bottom end of grader blade 100 is preferably beveled in order to match the ground surface when the blade is mounted on the moldboard and to increase the surface area of the grader blade 100 contacting the ground surface. If desired, the top end of grader blade 100 may likewise be beveled to form a suitable fit with the moldboard.

In the preferred embodiment, the grader blade 100 is made from a high strength steel, such as SAE 1020 flat hot rolled steel, and is nominally 0.75 inches thick, 6.0 inches wide and 4 feet long, within manufacturing tolerances. However, it should be recognized that the grader blade 100 may vary in length, width and thickness in accordance with the particular application. In addition, grader blade 100 may be curved to conform with any particular shape of the moldboard.

The front leading edge 300 of grader blade 100 is first embedded with particles of a very high wear-resistant material, preferably tungsten carbide. Tungsten carbide particles are extremely hard and abrasion resistant. The carbide particles are applied by heating the lower end of the grader blade such that the metal of the leading edge becomes molten and pools on the blade edge. Typical temperatures for heating the leading edge using SAE flat hot rolled steel in accordance with the present invention are on the order of 2600° F. The tungsten carbide particles are then applied to the molten metal so as to mix with, and become impregnated in, the material of grader blade 100. The grader blade is then allowed to cool.

The size and quantity of tungsten carbide particles to be applied to the pooled metal along the leading edge of blade 100 depends upon the level of increased wear-resistance desired, economics, the application for the blade 100, and similar factors. Tungsten carbide particles which sift between No. 4 and No. 20 size screens are appropriate for the present invention and can be applied to the leading edge in a density between about 5 and about 25 grams per square inch of blade surface. Densities less than 5 grs/in.$^2$ will not provide sufficient wear resistance and densities greater than about 25 grs/in.$^2$ become costly without added benefit in wear resistance. In the preferred form of this invention, it has been found that tungsten carbide particles having a size which sift between No. 8 and No. 16 size screens, applied in a quantity of about 14–17 grams per square inch of blade surface, achieve a very high wear-resistant leading edge in accordance with the present invention. If other high wear-resistant materials are employed, the size and quantity of the particles applied to the leading edge may vary.

By pooling the molten metal and applying the high wear-resistant tungsten carbide particles to the leading edge in this condition, the particles penetrate into the edge of the blade 100, preferably at least 1/16 inch to as much as 1/4 inch, and most preferably about 1/8 inch. In addition, the tungsten carbide particles and blade metal forming the leading edge protrude from the surface of the grader blade approximately a corresponding equal distance, preferably at least 1/16 inch to as much 1/4 inch and most preferably about 1/8 inch. The extent of the protrusion, also, may be varied in accordance with a particular application, and it is not always necessary that the extent of the protrusion correspond to the extent of the penetration.

The tungsten carbide particles form a high wear-resistant bead 310 that preferably runs the length of the grader blade 100. In the preferred embodiment, the height 320 of bead 310 is about 1.0 inch; however, this height can vary depending on the application of the blade, the embedded abrasion material and other factors relating to the manufacture of the blade 100. The preferred particles, such as the carbide particles, have a hardness of at least about RA 89. By embedding the carbide particles into the grader blade 100, the carbide is actually incorporated into the grader blade 100 itself. Therefore, the leading edge 300 is not subject to becoming dislodged from the grader blade 100.

Next, a groove 175 is milled in the center of the bottom edge 220 of grader blade 100, as shown in FIG. 2, preferably for the entire length of the blade. Carbide insert 200 is then fitted and secured into groove 175 so that the lower surface 210 of insert 200 is flush with the bottom edge 220 of the blade. Insert 200 also extends across the entire length of the blade. Preferably, insert 200 is formed by a plurality of short inserts fitted into groove 175 so as to position insert 200 in the center of lower edge 220 of grader blade 100. The inserts are placed end to end in groove 175 so as to form a continuous insert 200 that extends substantially the full length of grader blade 100. The separate inserts are secured in place by brazing each insert on the three sides that come into contact with the lower edge of the grader blade 100.

The inserts comprising insert 200 are also made from a high wear-resistant material. Such inserts are available commercially. A typical material is a known cemented carbide composition having a low cobalt content especially adapted for down pressure wear-resistance. Preferably, the cobalt content is within the range of 10–13% by weight and the inserts have a hardness of RA 87.8 to 88.5. More preferably, the cobalt content falls within the range 11.0 to 12.4 weight percent. Most preferably, the composition of the inserts 200 is approximately 88.5% tungsten carbide and 11.4% cobalt by weight. However, it will be readily understood by those skilled in the art that the composition of the inserts 200 can vary among various compositions and percentages depending upon the alloys and materials that are available for high down pressure wear-resistance at an economical cost.

In addition, each insert 200 is preferably about 1.0 inch long, and 0.365 inches wide and 0.635 inches deep at its front side and conforms with the dimensions of the groove 175 and the overall dimensions of the lower end of the blade 100. The width and depth of the groove dimensions exceed the insert dimensions by approximately 0.005 to 0.010 inches to allow for the brazing material. It is recognized, of course, that the size of inserts 200 may vary widely in accordance with the present invention depending upon the particular application being made for the blade, the selected size of the groove 175 and the ability to braze the insert into the groove.

While tungsten carbide particles are clearly the preferred material for forming the bead 310 of the embedded leading edge 300, it is possible that other materials may be employed to achieve an improved wear-resistant leading edge in accordance with the embedding technique of the present invention, especially when combined with the centrally located longitudinal insert 200 positioned behind the leading edge 300. Accordingly, it is not intended to limit the present invention solely to tungsten carbide particles for forming bead 310 of the embedded leading edge 300.

The embedded leading edge 300 prolongs the life of grader blade 100 by having a substantial amount of abrasion-resistant material in contact with the ground surface in addition to inserts 200. Furthermore, embedded leading edge 300 creates a protective shield along the face of the cutting edge of grader blade 100 that prevents metal in grader blade 100 from "washing out" or otherwise eroding away. Accordingly, embedded leading edge 300 prevents inserts 200 from becoming exposed and falling out, thus extending the useful life of the blade.

Based upon preliminary testing, grader blades made in accordance with the present invention have demonstrated a wear life of approximately 1,000–1,500 hours, or more, depending on the application. Conventional high carbon and/or heat treated blades have a useful life in the range of only 10–60 hours, depending on the blade dimension and grading application. Thus, blades made in accordance with the present invention will be much more cost effective both in dollars/hour of operation and in time and labor saved in frequent blade changes. Additionally, in gravel road grading applications, use of grader blades in accordance with the present invention will allow operators to maintain a correct and consistent road crown because the present blades are not subject to hollowing of the center portion of the blade that is characteristic of conventional blades.

In addition, based on preliminary testing, it is believed that blades made in accordance with the present invention will out perform conventional dual carbide configurations because the embedding of the high wear-resistant particles, such as tungsten carbide particles, on the leading edge in accordance with the present invention will maintain a sharper cutting edge, thus reducing power requirements. Further, it is believed that embedding the carbide particles into the leading edge of the blade in accordance with the present invention overcomes failures encountered with conventional dual carbide blades where the carbide segments are brazed onto the face of the blade and become loose and/or lost during high impact situations, seriously limiting the life of the blade.

The foregoing descriptions and drawings should be considered as illustrative only of the principles of the invention.

Numerous applications of the present invention will readily occur to those skilled in the art. Therefore, it is not desired to limit the invention to the specific embodiments disclosed or the exact construction and operation shown and described. Rather, all suitable modifications and equivalents may be resorted to, falling within the scope of the invention.

I claim:

1. A grader blade of the type capable of being secured to a moldboard, the grader blade comprising:

an elongated body having a bottom end and a front surface having a leading edge;

an elongated groove formed in said bottom end behind said front surface adjacent the leading edge;

at least one high wear-resistant insert secured in said groove behind said front surface along substantially the entire leading edge; and, a wear resistant material continuously embedded along at least half the entire length the leading edge of said body.

2. The grader blade of claim 1 wherein the wear-resistant material is tungsten carbide.

3. The grader blade of claim 1 wherein the wear-resistant material protrudes from the front surface of said body.

4. The grader blade of claim 1 wherein the wear-resistant material is embedded to the leading edge of said body by pooling molten metal on a portion of the surface of said body.

5. The grader blade as described in claim 1 wherein said groove forms a front layer and a rear layer of material of said body along a substantial portion of said bottom end, said at least one insert being secured between said front and rear layers.

6. The grader blade as described in claim 1 wherein said wear resistant material in said leading edge protects a substantial portion of said at least one insert.

7. The grader blade of claims 1, 5, or 6 wherein the insert is secured to the body by brazing.

8. A method of making a high wear-resistant grader blade which comprises the steps of forming a longitudinal groove near the center of the bottom edge of said blade substantially along the entire length of said bottom edge behind a leading edge of said blade adjacent said bottom edge, securing solid elongated inserts having a high down pressure wear-resistance in said groove behind said leading edge, and embedding particles of a hard and abrasion resistant material along substantially the entire leading edge and in front of said inserts.

9. A method of making a high wear-resistant grader blade in accordance with claim 8 wherein said embedding comprises heating said leading edge to pool molten metal along said leading edge, depositing particles of said hard and abrasion resistant material in said pooled molten metal, and cooling said leading edge so that said particles become embedded in said leading edge.

10. A method of making a high wear-resistant grader blade in accordance with claim 8 wherein said hard and abrasion resistant particles are tungsten carbide embedded in a quantity of about 5 to about 25 grams per square inch of leading edge surface.

11. A method of making a high wear-resistant grader blade in accordance with claim 8 wherein said at least one insert is secured in said groove by brazing.

12. A grader blade of the type capable of being secured to a moldboard which comprises:

a body having a bottom edge and a front surface with a leading edge adjacent said bottom edge;

at least one high wear-resistant carbide insert embedded in said body behind said front surface and forming a portion of said bottom edge along substantially the entire length of said blade; and a wear resistant material embedded substantially along the entire leading edge of said body and in front of said insert.

13. The grader blade of claim 12 wherein said high wear-resistant material is tungsten carbide particles that project into said leading edge of said body a distance of between about 1/16 inch and about 1/4 inch and protrude from said body between about 1/16 inch and about 1/4 inch.

14. The grader blade of claim 13 wherein said tungsten carbide particles are embedded along said leading edge in a density of about 5–25 grams/sq. inch.

15. The grader blade of claim 14 wherein the tungsten carbide particles form a bead along said leading edge having a height of about 1 inch.

16. The grader blade of claim 12 wherein said at least one high wear-resistant insert comprises a cemented carbide composition having a cobalt content within the range of 10 to 13%.

17. The grader blade as described in claim 12 wherein said insert is embedded in said body between a front layer and a rear layer of material of said body formed along substantially the entire length of said bottom edge.

18. The grader blade as described in claim 12 wherein said wear resistant material in said leading edge protects said at least one insert.

* * * * *